United States Patent [19]

Perold

[11] 4,059,255

[45] Nov. 22, 1977

[54] ADJUSTABLE TABLE FOR PHYSICAL THERAPY

[75] Inventor: Helmuth Conny Perold, Reseda, Calif.

[73] Assignee: Adjusting Tables Inc., N. Hollywood, Calif.

[21] Appl. No.: 804,886

[22] Filed: June 9, 1977

[51] Int. Cl.[2] ..... A61G 13/00

[52] U.S. Cl. ..... 269/323

[58] Field of Search ..... 269/322–324; 108/6, 138; 5/62, 63

[56] References Cited

U.S. PATENT DOCUMENTS

| | | | |
|---|---|---|---|
| 3,488,047 | 1/1970 | Hayat | 269/323 |
| 3,640,520 | 2/1972 | Wieland et al. | 269/325 |
| 3,806,109 | 4/1974 | Weber et al. | 269/323 |

FOREIGN PATENT DOCUMENTS

| | | | |
|---|---|---|---|
| 1,015,191 | 9/1956 | Germany | 269/323 |

*Primary Examiner*—Robert C. Watson

*Attorney, Agent, or Firm*—Ralph B. Pastoriza

[57] ABSTRACT

A physical therapy table is mounted on a platform and arranged to be vertically raised by the platform between first and second positions by a single hydraulic cylinder and piston arrangement. The frame of the table is further pivoted to the platform at a transverse pivot point in such a manner that the same hydraulic cylinder and piston can be used to tilt the table relative to the platform from a horizontal position towards a vertical position. A mechanical interlocking coupling is provided and responsive to movement of a pivoted foot rest at the end of the table to lock the table to the platform when the foot rest is in a folded out-of-the-way position so that operation of the hydraulic cylinder will raise and lower both the platform and table and to unlock the table from the platform when the foot rest is swung to a utilization position such that when the cylinder is actuated, the desired tilting takes place. A single hydraulic cylinder and piston thus serves to effect two distinct movements.

7 Claims, 6 Drawing Figures

ADJUSTABLE TABLE FOR PHYSICAL THERAPY

This invention relates generally to physical therapy tables or examining tables and more particularly to an improved adjustable table for physical therapy in which both raising and lowering and tilting movements can be effected by a single hydraulic cylinder and piston.

BACKGROUND OF THE INVENTION

Adjustable examining or treatment tables for physical therapy, chiropractic work, and the like are well known in the art. Generally these tables include an elongated table frame upon which are positioned cushioned sections which may slide along the frame to accommodate different sized persons. They also generally include a foot rest at one end of the frame. The frame itself is arranged to be adjusted in height as by an appropriate hydraulic system to raise the entire frame in a vertical direction.

In addition to the foregoing, the tables are generally capable of being tilted towards an upright position and towards this end, the foot rest is utilized as a support for the patient's feet when the table is moved towards this vertical position.

In order to provide for the above-described basic adjustments of raising and lowering the table and tilting the table, there has always been required at least two and usually more hydraulic cylinder and piston arrangements appropriately positioned to effect the desired movements. As a consequence, the tables are not only expensive to manufacture, but because of the large number of parts involved can become expensive to maintain. Moreover, multiple controls are provided when several hydraulic cylinders are used and should the wrong controls be operated; for example, the tilt control when it is intended to merely raise the patient while still horizontal, the patient may be tumbled from the bed and injured.

BRIEF DESCRIPTION OF THE PRESENT INVENTION

With the foregoing consideration in mind, the present invention contemplates a greatly improved adjustable table for physical therapy purposes such as for use by chiropracters wherein both vertical raising and lowering adjustments of the table and tilting of the table can be effected but wherein only a single hydraulic cylinder and piston and single control therefor is utilized. As a result, the table can not only be manufactured for considerably less money than required heretofore but less maintenance is required and the design is such that the risk of operating incorrect controls is minimized.

More particularly, in accord with this invention, a platform is mounted to a fixed base for vertical movement between a first normal position and a second raised position relative to the base. An elongated table frame in turn overlies the platform and is transversely pivoted thereto for angular movement between the referred to first normal position and a third tilted position.

A foot rest is transversely pivoted to one end of the elongated table frame and a sole hydraulic cylinder is disposed beneath the platform and generally oriented vertically with its lower end pivoted to the base. The piston rod from the cylinder extends through a cut-out in the platform to terminate in a pivoted connection to the underside of the table frame at a point spaced from the pivot point of the table frame to the platform.

The assembly is completed by the provision of locking means movable between a locked position in which the table frame is secured in a horizontal position to the platform to an unlocked position wherein the table frame is free of the platform except where the table frame is pivoted to the platform. This locking means is coupled to the foot rest in such a manner that when the foot rest is pivoted to a folded, out-of-the-way position, the locking means is moved to its locked position and actuation of the hydraulic cylinder can be effected to raise and lower the platform and table frame as a unit between the first normal position and the referred to second raised position.

When the foot rest, on the other hand, is pivoted to an extended position to provide a foot rest for the patient, this action automatically moves the locking means to its unlocked position such that subsequent actuation of the hydraulic cylinder can be effected to cause tilting of the table between the first normal position and the third tilted position.

It will be appreciated from the foregoing, that the table cannot be tilted inadvertently but rather requires the foot rest be in its proper position for supporting a patient when the table is tilted. Similarly, the table cannot be raised vertically unless the foot rest is in its folded out-of-the-way position. Since there is only one hydraulic cylinder involved, there need only be provided one control for this cylinder.

BRIEF DESCRIPTION OF THE DRAWINGS

A better understanding of this invention will be had by now referring to the accompanying drawings in which.

DETAILED DESCRIPTION OF THE PREFERRED EMBODIMENT

Figure 1:
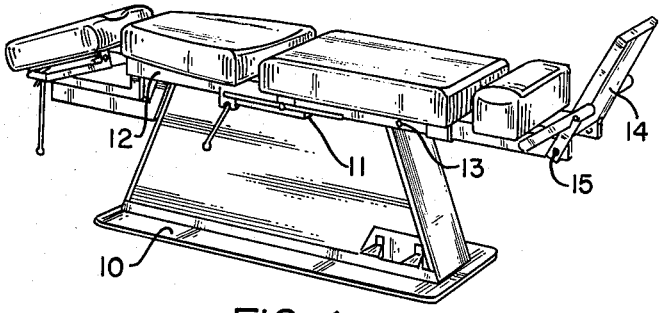
FIG. 1 is a perspective view of the adjustable table for physical therapy in accord with this invention showing the table in a normal first position but with the foot rest portion extended.

Referring first to FIG. 1, the adjustable table includes a fixed base 10. A platform 11 is mounted to this base for vertical movement between a first normal position and a second raised position relative to the base. Overlying the platform 11 is an elongated table frame 12 transversely pivoted to the platform as at 13 for angular movement between the first normal position and a third tilted position. A foot rest 14 is in turn pivoted to one end of the table frame 12 as at 15.

As will become clearer as the description proceeds, the foot rest 14 is arranged to be pivoted about the pivot 15 to an out-of-the-way position and this particular action operates an appropriate locking means such that when the foot rest 14 is in its out-of-the-way folded position, the table frame 12 can only be raised and lowered whereas when the foot rest 14 is in its operative extended position as illustrated in FIG. 1, the table frame 12 can only be tilted.

Figure 2:
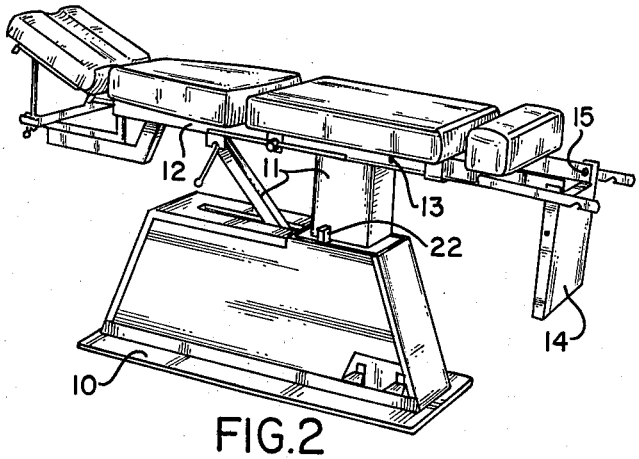
FIG. 2 is a view similar to FIG. 1 but showing the table in a second raised position which can only be effected after the foot rest portion has been folded to an out-of-the-way position.

Thus, with reference to FIG. 2, the foot rest 14 is shown in its folded, out-of-the-way position wherein the table frame is now in condition to be raised and lowered. In FIG. 2, the table frame is shown in its second raised position supported by the platform 11, this platform 11 as described with respect to FIG. 1 being guided for vertical movement relative to the fixed base 10.

Figure 3:
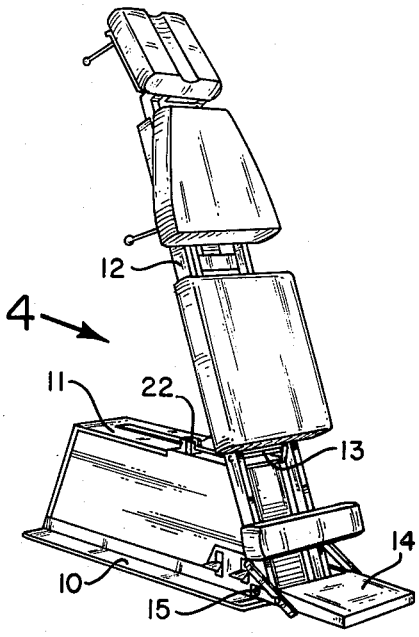
FIG. 3 is another perspective view showing the table in a third tilted position with the foot rest in its operative orientation.

FIG. 3, on the other hand, shows the foot rest in the same position as FIG. 1 with the table in its third tilted position. The locking mechanism operated by the foot rest 14 as will become clearer, is such that the table can only be moved to its tilted position shown in FIG. 3 when the foot rest 14 is in the illustrated operative state so that the patient will be appropriately supported.

Figure 4:
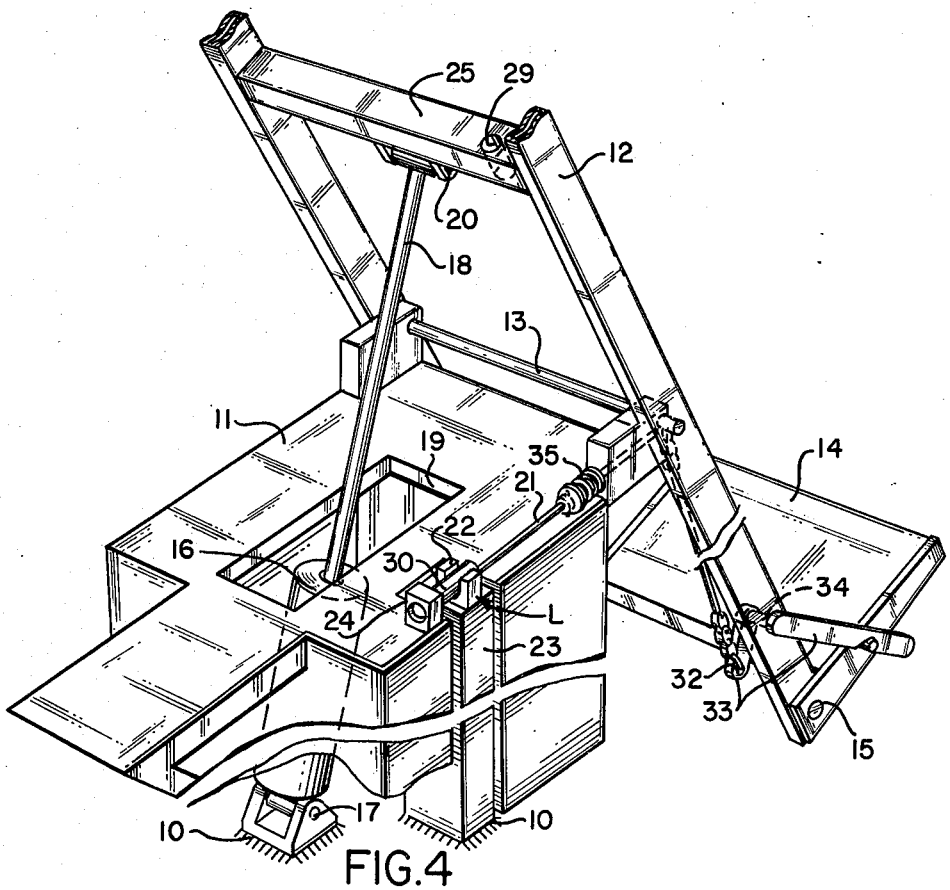
FIG. 4 is an enlarged fragmentary diagrammatic type perspective view of the operating mechanism for the table looking generally in the direction of the arrow 4 of FIG. 3.

Referring now to FIG. 4, the manner in which the foregoing adjustments are effected by a single hydraulic cylinder will be evident. As shown in FIG. 4, the sole hydraulic cylinder is illustrated at 16 disposed beneath the platform 11 and generally oriented vertically with its lower end pivoted to the fixed base 10 as at 17. A piston rod 18 extends from the cylinder, the platform itself including a central cut-out 19 through which this piston rod passes. The extending end of the piston rod is pivoted to the underside of the table frame 12 as at 20, this pivot point being spaced from the pivot 13 of the table frame 12 to the platform 11.

Shown adjacent to the cut-out 19 on the platform 11 is a locking mechanism designated generally by the arrow L. This locking mechanism in turn is coupled by appropriate means 21 to the foot rest 14.

The locking means itself includes a first block 22 fixed to the base 10 as by column 23 so that it always remains stationary. As will be described in greater detail subsequently, this fixed block 22 has a first horizontal bore therethrough with a slot opening out the top of the bore. A second block 24 is fixed to the platform 11 and includes a second horizontal bore therethrough in axial alignment with the first mentioned bore in the fixed block 22 when the table frame is in its first normal position. A third block 25 is secured to the underside of the table frame 12 as shown in FIG. 4 and includes a third bore therethrough positioned to be in axial alignment with the first and second bores in the blocks 22 and 24 when the table frame is in the heretofore referred to first normal position on the platform.

Figure 5:
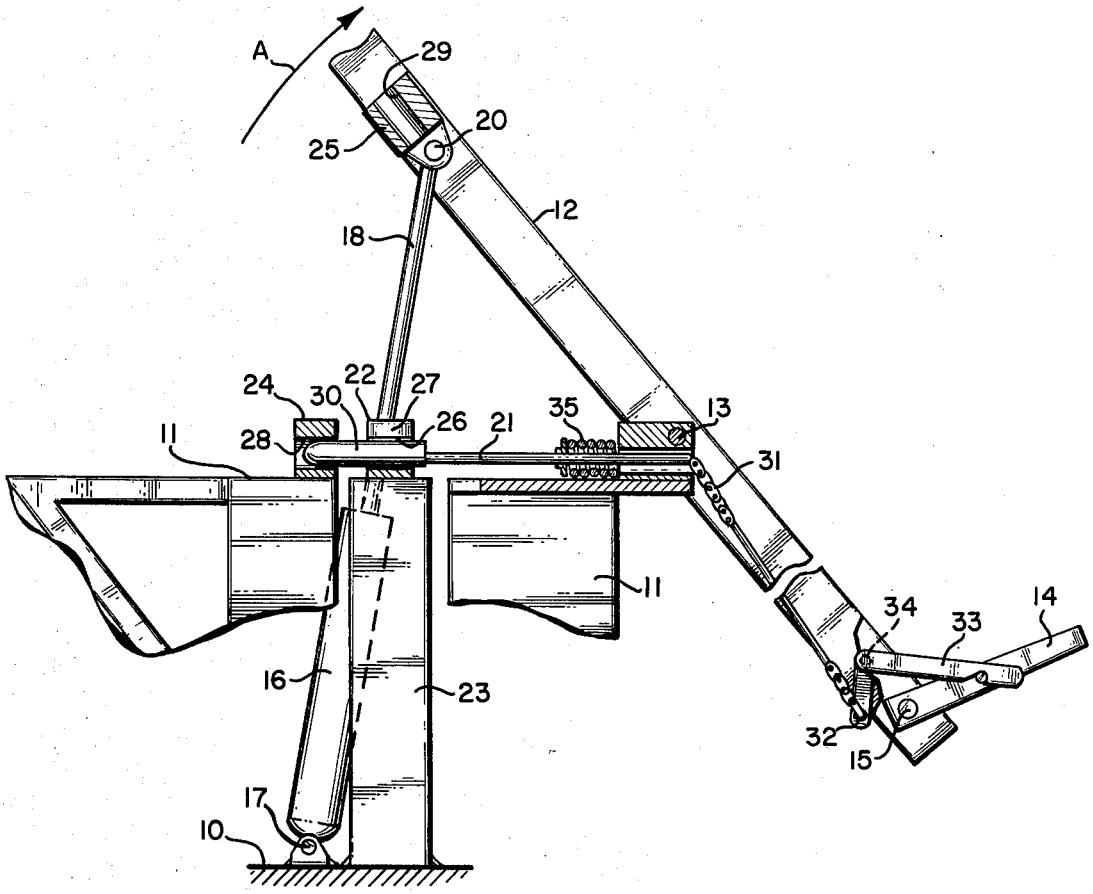
FIG. 5 is a fragmentary side view partly in cross section illustrating the operating mechanism for the table when in its third tilted position; and, FIG. 6 is a view similar to FIG. 5 but illustrating the table in its first normal position and by means of dotted lines in its raised second position.
Figure 6:
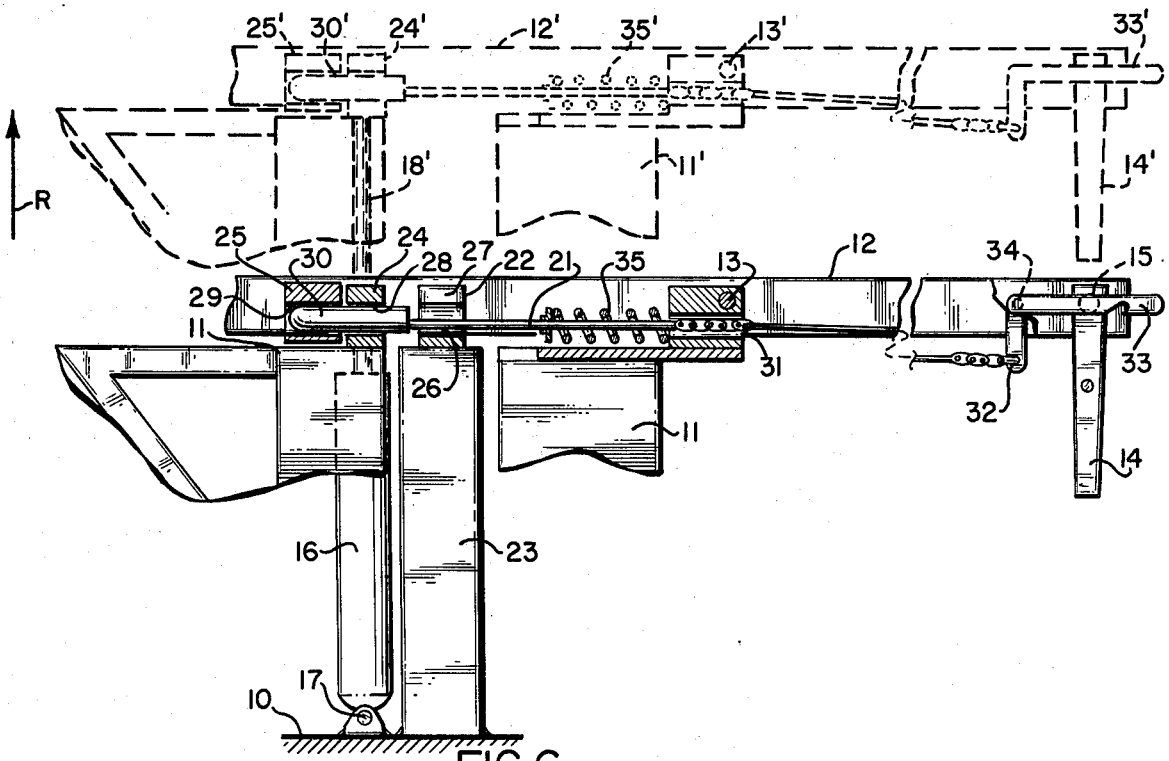

The arrangement of the blocks can better be understood by reference to both FIGS. 5 and 6. Thus, in FIG. 5 the first bore in the fixed block 22 is indicated at 26 with the upper slot opening shown at 27. The second bore for the block 24 fixed to the platform 11 is indicated at 28 and the third bore for the block 25 secured to the underside of the table frame 12 as indicated at 29.

As shown in FIG. 5, there is further included in the locking means a horizontally movable locking pin 30 of length sufficient to be received in the first and second bores 26 and 28 but terminating short of the third bore 29 when the locking means is in its unlocked position.

Referring to FIG. 6, when the table frame 12 is in its first normal horizontal position, the axial alignment of the bore in the block 25 with the bores in the fixed block 22 and block 24 will be evident. In FIG. 6, the pin 30 is shown as having been moved to a locked position wherein it is received in the second and third bores of the blocks 24 and 25 but is free of the first bore in the block 22.

Referring back to FIG. 5, movement of the pin 30 between its unlocked and locked positions is effected by the heretofore referred to coupling means 21 passing to the foot rest 14. This coupling means 21 may take the form of an appropriate push rod including a flexible portion 31 to permit bending of the coupling when the table frame 12 is tilted. The far end of the rod 21 past the flexible portion 31 terminates in a pivoted connection 32 to a bell crank type lever 33 pivoted at 34. The opposite end of the bell crank lever 33 from the pivot point 32 is arranged to be coupled to a pin on the foot rest 14 when the foot rest is swung from its folded out-of-the-way position to its operative position. Thus, in the showing of FIG. 5, the locking pin 30 is in its unlocked position, the foot rest 14 being in its operative position. In FIG. 6, the foot rest portion is shown in its folded out-of-the-way position and it will be evident that the folding action results in uncoupling of the foot rest from the bell crank 33 thereby permitting the pin 30 to be moved to its locked position illustrated in FIG. 6. In this respect, in the particular embodiment disclosed, there is provided an appropriate biasing spring 35 normally biasing the pin 30 towards its locked position illustrated in FIG. 6.

OPERATION

Referring specifically to FIG. 6, the locking pin as described is shown in its locked position wherein it extends only within the bores for the block 24 and block 25 thereby essentially locking the table frame 12 to the platform 11. This locking is achieved since the block 24 which is disposed between the fixed block 22 and the block 25 on the table frame 12 is affixed to the platform 11. It is thus not possible for the table frame 12 to pivot about the point 13 relative to the platform 11 when the locking pin 30 is in its locked position shown. It will be noted that the pin is biased to this position as described by the biasing spring 35 and the position can only be assumed when the foot rest 14 is in its folded, out-of-the-way position as shown in FIG. 6.

It will now be clear that if the hydraulic cylinder is actuated, the piston rod 18 will exert a force on the underside of the table frame 12 and result in the entire table frame and platform 11 being raised as a unit to the second raised position illustrated in FIG. 2. Thus, in this operation, the coupling 21 will pass out through the slot 27 in the fixed block 22, the intermediate block 24 fixed to the platform and the block 25 fixed to the underside of the table frame remaining in coaxial locked relationship by the pin 30. These portions of the apparatus are illustrated in phantom lines showing the table in its raised position, the identifying numerals being primed.

By reversing the action of the hydraulic cylinder 16, the table frame and platform may be lowered to the solid line position illustrated in FIG. 6.

If it is now desired to tilt the table, it is first necessary to reposition the foot rest 14 to its operative extended position illustrated in FIG. 1 and in FIG. 5. Thus, when the foot rest 14 is swung about the pivot 15, it will engage the bell crank link 33 swinging the same about the pivot point 34 and thereby pulling on the coupling 21 against the bias of the spring 35 to move the pin 30 into the position illustrated in FIG. 5 wherein it frees the block 25 secured to the underside of the table frame 12. This movement of the locking pin 30 to its unlocked position as illustrated in FIG. 5 will also effectively lock the platform to the base 10 through the first block 22 which is always in a fixed position through the column 23. In other words, the platform cannot move relative to the base because of its being held by the locking pin 30 and associated blocks 24 and 22 as shown in FIG. 5.

If now the hydraulic cylinder 16 is actuated, the table frame 12 will necessarily tilt about the pivot 13 since this is the only motion it can execute in response to the hydraulic force. This tilting action is clearly depicted in FIG. 5 wherein it will be noted that the block 25 in its associated bore 29 are free of the pin 30.

If it is again desired to simply raise or lower the table, it must first be tilted back to its first normal horizontal position and the foot rest 14 folded to its out-of-the-way position as illustrated in FIG. 6. This action thus frees the coupling 21 so that the biasing spring 35 can move the pin 30 into the block 24 and block 25 on the underside of the table frame 12 thereby locking the platform 11 to the table frame as described. It will also be evident that movement of the pin 30 to the locked position illustrated in FIG. 6 frees the pin from the bore in the fixed block 22 so that the platform 11 is no longer locked to the base 10 by way of the column 23 and is thus free to move in an up and down direction with the table frame 12 as a unit.

From all of the foregoing, it will be evident that since only a single hydraulic cylinder is utilized, there need be provided only a single set of controls for operating the hydraulics to move the piston either outwardly or inwardly of the cylinder. As described, if the foot rest 14 is in its folded, out-of-the-way position, operation of the hydraulic cylinder 16 to move the piston 18 out of the cylinder will result in a raising and lowering of the entire table and platform whereas when the foot rest 14 is moved to its operative position as illustrated in FIG. 5, operation of the same cylindrical hydraulic control to extend the piston from the cylinder 16 will result in the desired tilting action.

From the foregoing description, it will thus be evident that the present invention has provided a greatly improved adjustable table for physical therapy purposes wherein desired adjustments can be effected by only a single hydraulic cylinder and single control therefor as opposed to the use of multiple cylinders as required heretofore.

I claim:

1. An adjustable table movable between a first normal position to a second raised position and between said first normal position and a third tilted position; a foot rest on said table movable between a folded out-of-the-way position and an extended usable position; and an intercoupling means between said foot rest and said table such that when said foot rest is in said folded out of the way position said table is constrained to movement only between said first normal position and said second raised position and when said foot rest is in its extended usable position said table is constrained to movement only between said first normal position and said third tilted position.

2. An adjustable table including, in combination:

a. an elongated table frame;

b. a foot rest pivoted at one end to said elongated table frame; and, c. means responsive to said foot rest capable of only raising and lowering said table in a vertical direction when said foot rest is in a folded out-of-the-way position and capable of only tilting said table frame when said foot rest is in an extended usable position.

3. The subject matter of claim 2, in which said means responsive to said foot rest includes a sole hydraulic cylinder and piston connected to move said table frame and a locking means coupled to said foot rest for:

a. constraining said table frame to vertical movement when said foot rest is in said folded out-of-the-way position so that operation of said hydraulic cylinder can only raise and lower said table frame, and b. constraining said table frame to tilting movement only when said foot rest is moved to its extended usable position so that operation of said same hydraulic cylinder can only tilt said table frame.

4. An adjustable table for physical therapy comprising, in combination:

a. a fixed base;

b. a platform mounted to said base for vertical movement between a first normal position and a second raised position relative to said base;

c. an elongated table frame overlying said platform and transversely pivoted thereto for angular movement between said first normal position and a third tilted position;

d. a foot rest transversely pivoted at one end of said elongated table frame;

e. a sole hydraulic cylinder disposed beneath said platform and generally oriented vertically with its lower end pivoted to said base;

f. a piston rod extending from said cylinder, said platform including a central cut-out through which said piston rod passes, the extending end of said piston rod being pivoted to the underside of said table frame at a point spaced from the pivot point of said table frame to said platform;

g. locking means movable between a locked position in which said table frame is secured in a horizontal position to said platform, to an unlocked position wherein said table frame is free of said platform except where the table frame is pivoted to the platform; and, h. means coupling said locking means to said foot rest whereby when said foot rest is pivoted to a folded out-of-the-way position, said locking means is moved to its locked position and actuation of said hydraulic cylinder can be effected to raise and lower said platform and table frame as a unit between said first normal position and said second raised position, and whereby when said foot rest is pivoted to an extended position at the end of said table frame, said locking means is moved to its unlocked position and actuation of said hydraulic cylinder can be effected to cause tilting of said table between said first normal position and said third tilted position.

5. The subject matter of claim 4, in which movement of said locking means to said unlocked position further secures said platform to said base and movement of said locking means to said locked position further frees said platform from said base for vertical movement relative to said base.

6. The subject matter of claim 5, in which said locking means includes: a first block fixed to said base adjacent to the plane of said platform and having a first horizontal bore therethrough with a slot opening out of the top of said bore; a second block fixed to said platform and having a second horizontal bore therethrough in axial alignment with said first bore when said platform and table frame are in their normal first position; a third block secured to the underside of said table frame and having a third bore therethrough positioned to be in axial alignment with said first and second bores when said table frame is in said first normal position on said platform, said second block being positioned between said first and third blocks; an horizontally movable locking pin of length sufficient to be received in said first and second bores but terminating short of said third bore when said locking means is in its unlocked position, and to be received in said second and third bores but free of said first bore when said locking means is in its locked position; and an actuating rod secured to one end of said pin and of smaller diameter than said pin so that it can pass upwardly through said slot in said first bore when said locking means is in its locked position and said platform and table frame are raised, the other end of said actuating rod being coupled to said foot rest and responsive to pivoting movement of said foot rest to move said pin to positions defining said locked position and said unlocked position, said rod including a flexible section so that it can bend when said table frame is tilted relative to said platform.

7. The subject matter of claim 6, including means biasing said pin to its locked position.

* * * * *